US006745857B2

(12) United States Patent
Gjedebo

(10) Patent No.: US 6,745,857 B2
(45) Date of Patent: Jun. 8, 2004

(54) METHOD OF DRILLING SUB-SEA OIL AND GAS PRODUCTION WELLS

(75) Inventor: Jon G. Gjedebo, Stavanger (NO)

(73) Assignee: National Oilwell Norway AS, Stavanger (NO)

( * ) Notice: Subject to any disclaimer, the term of this patent is extended or adjusted under 35 U.S.C. 154(b) by 0 days.

(21) Appl. No.: 10/247,149

(22) Filed: Sep. 19, 2002

(65) Prior Publication Data

US 2003/0062199 A1 Apr. 3, 2003

Related U.S. Application Data

(60) Provisional application No. 60/323,958, filed on Sep. 21, 2001.

(51) Int. Cl.[7] ..... E21B 21/14; E21B 7/12

(52) U.S. Cl. ..... 175/69; 175/65; 175/66; 175/72; 166/358

(58) Field of Search ..... 175/5, 7, 25, 65, 175/66, 70, 72, 69, 205, 206, 207, 212; 166/358; 507/103, 910, 904

(56) References Cited

U.S. PATENT DOCUMENTS

| | | | | | |
|---|---|---|---|---|---|
| 3,684,038 | A | | 8/1972 | Nelson | |
| 3,815,673 | A | * | 6/1974 | Bruce et al. | 166/359 |
| 3,849,316 | A | * | 11/1974 | Motley et al. | 507/219 |
| 4,091,881 | A | * | 5/1978 | Maus | 175/7 |
| 4,091,884 | A | | 5/1978 | Thomas | |
| 4,099,583 | A | * | 7/1978 | Maus | 175/7 |
| 4,149,603 | A | | 4/1979 | Arnold | |
| 4,253,530 | A | | 3/1981 | Sharki et al. | |
| 4,394,880 | A | | 7/1983 | Faulkner | |
| 4,813,495 | A | | 3/1989 | Leach | |
| 5,411,105 | A | | 5/1995 | Gray | |
| 5,663,121 | A | | 9/1997 | Moody | |
| 5,944,195 | A | | 8/1999 | Huang et al. | |
| 6,035,952 | A | | 3/2000 | Bradfield et al. | |
| 6,102,673 | A | | 8/2000 | Mott et al. | |
| 6,216,799 | B1 | | 4/2001 | Gonzalez | |
| 6,234,258 | B1 | | 5/2001 | Karigan | |
| 6,263,981 | B1 | | 7/2001 | Gonzalez | |
| 6,328,107 | B1 | * | 12/2001 | Maus | 166/335 |
| 6,347,675 | B1 | * | 2/2002 | Kolle | 175/69 |
| 6,530,437 | B2 | * | 3/2003 | Maurer et al. | 175/5 |
| 6,536,540 | B2 | * | 3/2003 | de Boer | 175/70 |
| 2003/0130134 | A1 | * | 7/2003 | Oram | 507/118 |
| 2003/0225173 | A1 | * | 12/2003 | Albright et al. | 521/51 |

FOREIGN PATENT DOCUMENTS

| | | |
|---|---|---|
| WO | 01/94740 | 12/2001 |

* cited by examiner

*Primary Examiner*—David Bagnell
*Assistant Examiner*—T. Shane Bomar
(74) *Attorney, Agent, or Firm*—Andrus, Sceales, Starke & Sawall, LLP

(57) ABSTRACT

A method of drilling sub-sea oil and gas production wells in which a liquid hydrocarbon substance, such as a natural gas liquid, is injected into the drilling mud supplied to the well in order to reduce the mud density. The method of the present invention enables reduction and control of the hydraulic pressure of the drilling mud while drilling production wells in deep water, thereby to require fewer casing runs which eventually yields better oil productivity.

18 Claims, 3 Drawing Sheets

METHOD OF DRILLING SUB-SEA OIL AND GAS PRODUCTION WELLS

CROSS REFERENCE TO RELATED APPLICATION

This application is based on and claims priority from U.S. Provisional Patent Application No. 60/323,958 filed on Sep. 21, 2001.

BACKGROUND AND SUMMARY OF THE INVENTION

The present invention relates to a method of reducing the density of returning drilling mud in a riser such that it approaches the pressure of an ambient sea water column at a given depth.

The best conventional drilling practice is to use weighted drilling fluids to balance the formation pressure to prevent fracture and lost drilling fluid circulation at any depth. The weight material is often suspended bentonite or barite particles and the drilling fluid can be formulated with oil or water as a continuous phase. It should be noted that the circulation time for the complete mud system lasts for several hours, thus making it impossible to repeatedly decrease and increase mud density in response to sudden pressure variations (kicks) or lost mud circulation.

When drilling in deep water, the hydrostatic pressure of the drilling fluid column in the riser exceeds that of the corresponding sea-water column and it becomes impossible to balance the formation pressure by manipulating the mud weight. To protect the "open hole" sections from fracture and lost mud circulation, the practice is to progressively run, and cement, casings, the next inside the previous. For each casing run, the diameter incrementally decreases until the production zone is eventually reached.

It is important that the well be completed with the largest practical diameter through the production zone. This allows high production rates to justify the high-cost of deep water development. Too small a production casing could potentially limit the productivity of the well to the extent that it becomes uneconomical to complete.

The water depth significantly affects the number of casings run and it represents one of the limiting factors in the application of conventional drilling practice in deep-water development. Various concepts have been proposed to overcome this limitation, however none of these concepts known in the prior art have gained commercial acceptance for drilling in deep waters. These concepts can be generally grouped into two categories, the mudlift drilling with marine riser concept, and the riserless drilling concept.

These concepts should not be confused with the concept of under-balanced drilling. Under-balanced drilling is basically conducted when the drilling operation is performed into the oil and gas bearing formation (pay-zone). In under-balanced drilling the hydrostatic pressure of the mud column is kept below the formation pressure in order to prevent suspended mud particles from entering and blocking the permeable oil bearing formation. Under-balanced drilling is generally prohibited and is definitely not performed outside the pay-zone for safety reason.

The riserless drilling concept contemplates removing the large diameter marine riser as a return annulus and replacing it with one or more return mud lines. Sub-sea pumps are used to lift the mud returns from the seabed to the surface. Variations over this concept are described in the following U.S. Pat. Nos. 6,263,981; 6,216,799; 4,813,495; 4,149,603.

These patents generally present the same riserless system, but they are implemented using different associated pumping apparatus and/or power transmission systems. Common features are that the pump is placed at the seabed and that they all require some degree of milling or particle size reduction of the cuttings before pumping in order to avoid erosion and aggregation of the cuttings.

These "pumped" systems are hampered by high cost and potential reliability problems, which are associated with the power supply and mechanics of maintaining complex sub sea systems for pumping of a suspension containing solids (cuttings).

The mudlift concept includes in principle introducing means to change the density of the returning drilling fluid at the sea bed to such a degree that the density of the fluid in the riser approaches the density of sea water.

Several mudlifit concepts are described:

1. Injecting gas (i.e. nitrogen, $CO_2$, exhaust gas, or air) into the mud return line at various points in the riser. U.S. Pat. Nos. 6,234,258; 6,102,673; 6,035,952; 5,663,121; 5,411,105; 4,394,880; 4,253,530; 4,091,884. The concept of using nitrogen, has become common practice when an under-balanced drilling operation is performed in an oil bearing formation. These gas lift systems tend to cause sluggish pressure fluctuation when operated in deep water and are hampered by foaming and separation problems at the topside, mud separation system.
2. Diluting the mud returns with mud-base at the sea bed. U.S. Pat. No. 3,684,038. This system requires that the mud-base is recovered from the mud, which in principle means that the suspended weight material is separated from the mud. The separation process is difficult because the size of the bentonite or barite particles to be separated ranges from 1–10 micron. The concept of diluting the mud returns with mud-base to approach the density of sea water is not suitable for water-based mud since it would require infinite dilution, and for oil-based mud it would also require a high dilution ratio because of the inherently small density differences between oil and seawater. A high dilution ratio might impose dramatic changes in the rheological properties of the drilling fluid so that the carrying capacity for cuttings is lost.
3. It has been proposed to replace bentonite or barite with paramagnetic weight particles (hematite: $Fe_2O_3$) i.e. U.S. Pat. No. 5,944,195, and recover the mud-base as described above (2) with a magnetic separator. This concept has apparently not been implemented.
4. Injecting hollow glass or composite spheres in the mud return line at the sea bed. This process has been originally proposed for under-balanced drilling in U.S. Pat. No. 6,035,952, and has since also been proposed in published PCT Application No. WO 01/94740, published Dec. 13, 2001 by Maurer Technology Inc. of Houston, Tex. USA. The size of commercially available hollow spheres, manufactured by 3M Company, ranges from 10 to 100 micron with density of 0.38 to 0.53 g/cm$^3$. These spheres are too small for efficient separation by conventional oilfield shale shakers, centrifuges or hydrocyclones, and they will collapse at pressures above 300 bar. It has however been proposed by Maurer Technology to develop and manufacture large, 10 mm, composite spheres which can tolerate pressures up to 500 bar. These spheres would have a density ranging from 0.43 to 0.68 g/cm$^3$. They have not been put into practice and are not commercially available.

SUMMARY OF THE INVENTION

The present invention is directed to a mud-lift system based on the injection of a liquid natural gas such as NGL, ethane, propane, butane or pentane at the mud return line. The density of these liquids is in the range of 0.35 –0.58 g/cm$^3$ under prevailing conditions, which compares favorably with hollow composite spheres since application of natural gas liquid has no upper pressure limitations. For water-based mud, the liquid is recovered from the mud in a pressurized two-phase gravity separator; for oil based mud, the liquid is recovered in a reboiler. The design of such recovery systems is basic knowledge for those skilled in the art.

The present invention offers the advantage of eliminating the need for sub-sea rotating equipment. It also offers an inherent flexibility to reach a target hydraulic pressure by selecting among different natural gas liquids (C2 through C5) and/or, by varying both the injection rate or the point of injection. The injection can also be located at multiple points in the well, which will provide means of creating a curved density gradient. It is not possible to achieve a curved density gradient in the well by the application of sub-sea pumps at the sea bed. See U.S. Pat. No. 3,684,038.

Various other features, objects, and advantages of the invention will be made apparent from the following detailed description and the drawings.

DETAILED DESCRIPTION OF THE INVENTION

Figure 2:
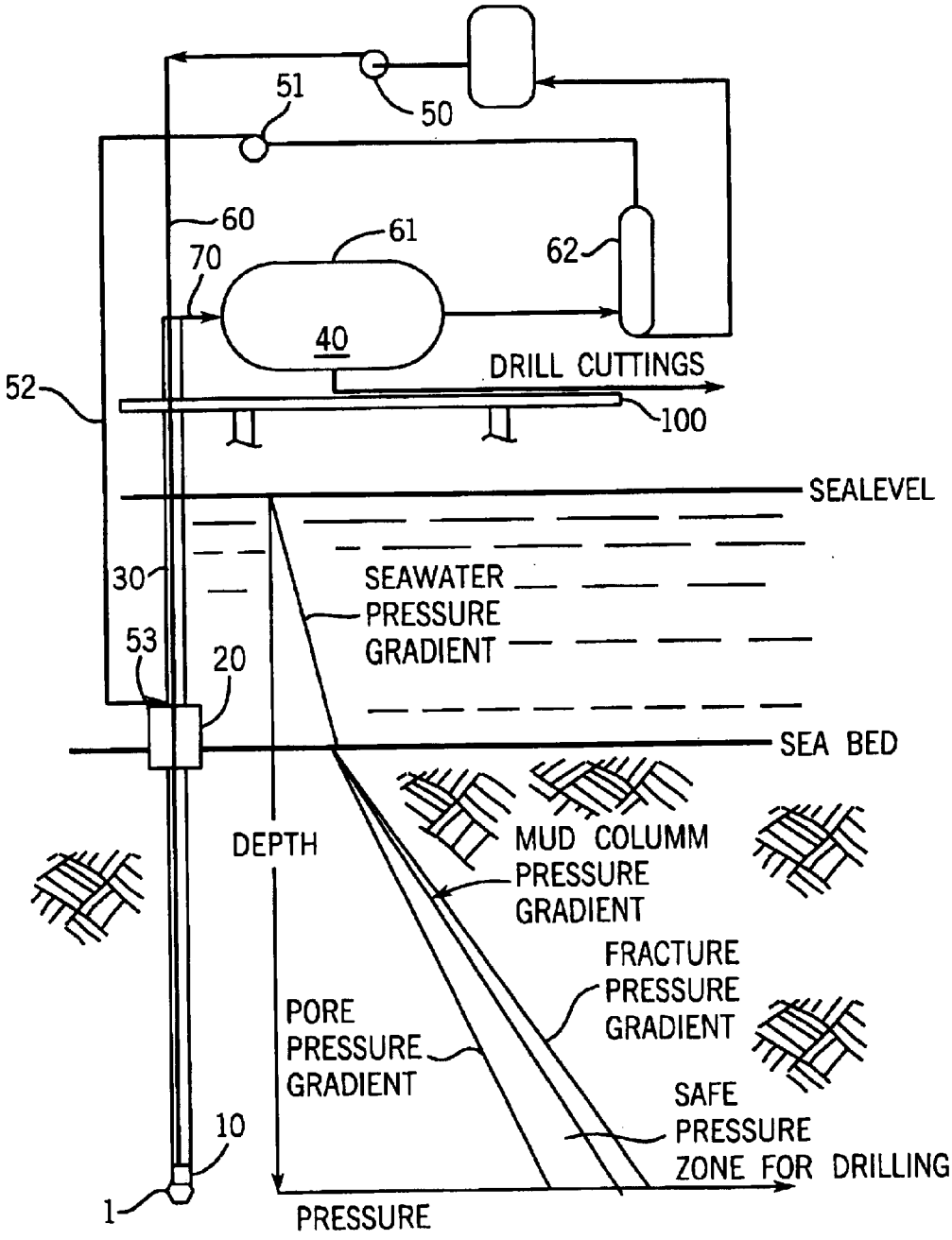
FIG. 2 illustrates the method of the present invention.

FIG. 2 indicates the hydraulic pressure gradient of the mud column and of the rock formation at various depths. The corresponding critical fracture-pressure gradient is also indicated. It is important to note that the pressure gradient in the formation is substantially higher than that of seawater due to the inherent density differences between water and the rock formation.

Figure 1:
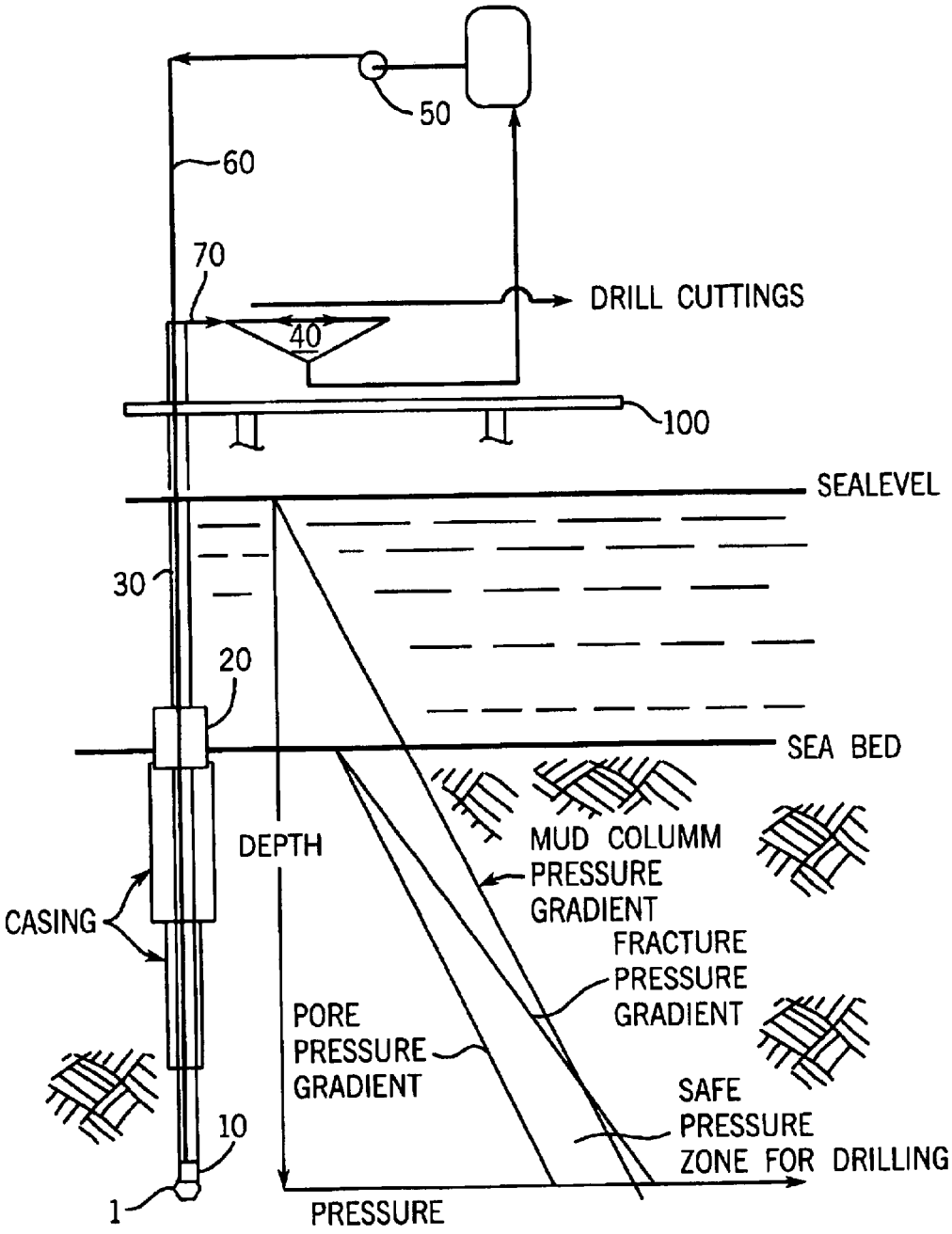
FIG. 1 PRIOR ART
FIG. 1 illustrates a conventional, sub-sea drilling operation.

With reference to FIG. 1, it should be noted that a large number of casing strings is required in conventional drilling as a result of the narrow operating range provided by the closeness of the fracture pressure gradient to the pore pressure gradient. It is necessary when drilling in overpressure regions, to use a mud weight that exceeds the pore pressure in order to reduce the risk of a kick. At the same time, the mud weight cannot produce a pressure gradient that exceeds the fracture pressure gradient for a particular depth or the formation will be damaged, permitting lost mud circulation. The safe pressure zone is illustrated in FIG. 1 and also in FIG. 2.

The ultimate goal is to formulate the mud such that the hydraulic pressure at any depth falls in the safe pressure zone. This cannot be achieved by a conventional drilling system because the pressure exhibited by the mud column in the marine riser exceeds that of seawater. It should also be noted that if the hydraulic pressure exceeds the fracture pressure, casings have to be run in order to protect the well.

FIG. 2 illustrates that no casings are, in principle, needed for the present invention since the mud density gradient falls within the safe pressure zone during the whole drilling operation.

With reference to FIG. 1, the mud circulation system of a conventional sub-sea drilling operation is characterized by the following units: drilling platform 100, drill bit 1 powered by mud motor 10, blow-out-preventer stack 20, marine riser 30, mud return line 70, cuttings separation and mud recovery system 40, mud pump 50, and mud supply line 60.

The mud circulation system of the present invention, shown in FIG. 2, differs from a conventional system in that the cuttings removal unit 40 is present inside a pressure vessel 61 and the mud recovery system 62 comprises a reboiler for oil based mud, or a pressurized two-phase separator for water-based mud. In addition, the present invention is characterized by a condensate injection pump 51 and a condensate line 52, which feed the liquid hydrocarbon gas condensate to the point of injection 53 at the sea bed. Where drilling is conducted on offshore oil and gas production facility on platform 100, natural gas liquids may be collected from one of the associated process streams for supply to line 52 in conduct 54, as shown in FIG. 3.

Figure 3:
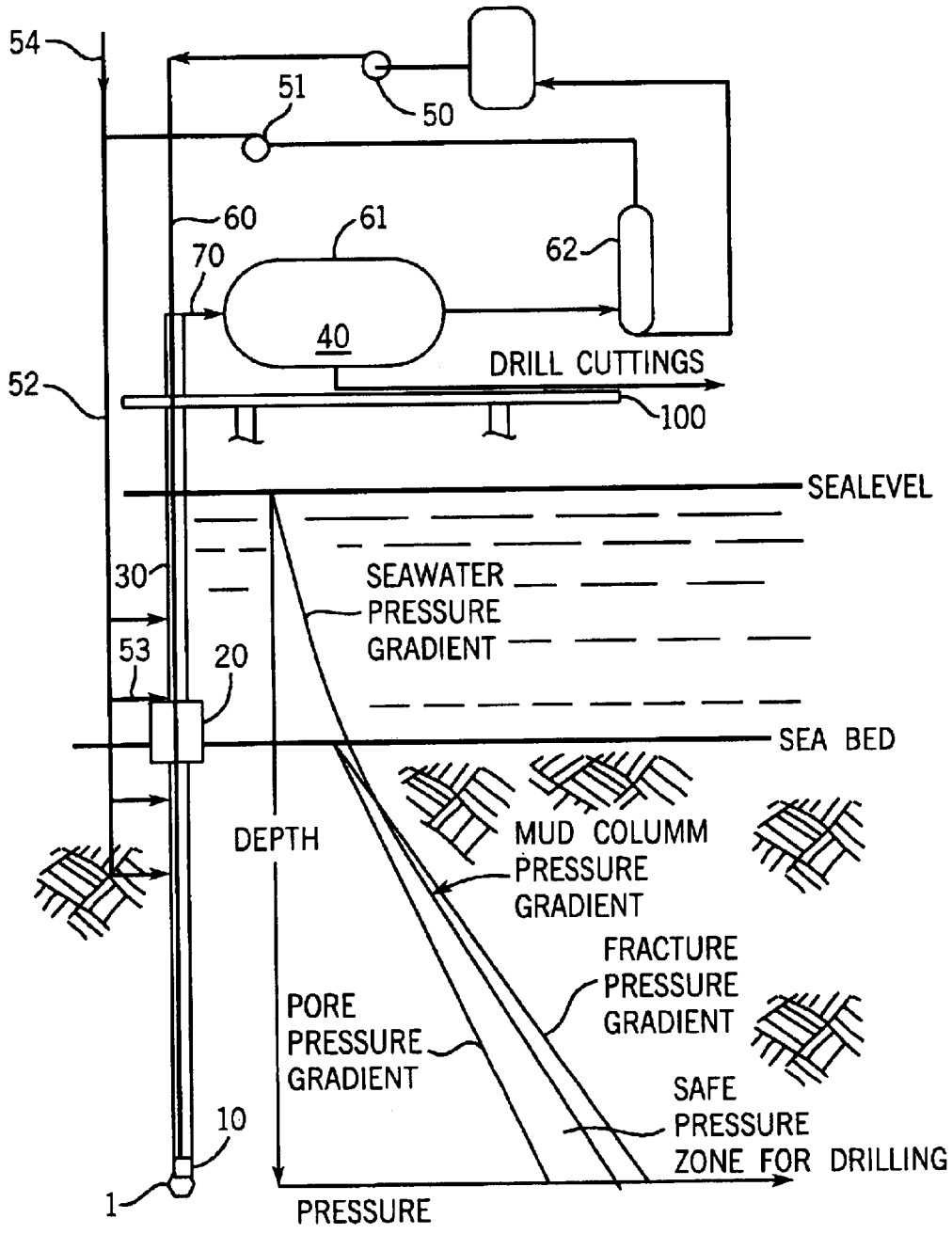
FIG. 3 further illustrates the method of the present invention.

FIG. 3 also shows injection at multiple points in the well to create a curved density gradient.

It should be noted that the present invention is based on using commercially available equipment and systems for the needed individual units or apparatus.

The following Table illustrates the dilution ratio needed for various natural gas liquid-components in order to reduce the density of the mud by 50%, from 2.0 to 1.0.

| NGL Component | Standard liquid density | Density 200 bar | Dilution m$^3$/m$^3$ |
|---|---|---|---|
| Ethane | 0.356 | 0.426 | 1.7 |
| Propane | 0.507 | 0.541 | 2.2 |
| Butane | 0.583 | 0.607 | 2.5 |
| Pentane | 0.630 | 0.647 | 2.8 |
| Drilling fluid | 0.746 | | |

It is apparent from the above table that liquid ethane possesses a relatively high degree of compressibility compared to the heavier NGL components. The density at 200 bar was conservatively used to estimate the dilution ratio needed to reduce the density from 2 to 1.

It is recognized that other equivalents, alternatives, and modifications aside from those expressly stated, are possible and within the scope of the appended claims.

What is claimed is:

1. A method of reducing the density of mud supplied to a well during drilling for the production of oil and gas from a subsea reservoir comprising:

injecting a liquid hydrocarbon substance which is lighter than the mud into the flow of mud supplied to the well while drilling; and adjusting at least one of the injection rate and the point of injection of the liquid hydrocarbon substance into the mud flow to reduce the density of the mud and reach a desired pressure gradient in the mud flow.

2. A method according to claim 1 further defined as injecting a liquid hydrocarbon substance having a density selected to achieve the desired pressure gradient.

3. A method according to claim 2 wherein the liquid hydrocarbon substance comprises a single component of ethane, propane, butane or pentane.

4. A method according to claim 2 wherein the liquid hydrocarbon substance comprises a multi-component natural gas liquid (NGL).

5. A method according to claim 1 further defined as injecting the liquid hydrocarbon substance into the mud flow at a plurality of points along a flow path for the mud.

6. A method according to claim 5 further defined as injecting the liquid hydrocarbon substance at the plurality of points to create a curved, density gradient in the mud flow.

7. A method according to claim 1 wherein the mud is water-based.

8. A method according to claim 7 wherein the liquid hydrocarbon substance comprises a single component of ethane, propane, butane or pentane.

9. A method according to claim 7 wherein the liquid hydrocarbon substance comprises a multi-component natural gas liquid (NGL).

10. A method according to claim 1 where the mud is oil-based.

11. A method according to claim 10 wherein the liquid hydrocarbon substance comprises a single component of ethane, propane, butane or pentane.

12. A method according to claim 10 wherein the liquid hydrocarbon substance comprises a multi-component natural gas liquid (NGL).

13. A method according to claim 1 wherein the liquid hydrocarbon substance comprises a single component of ethane, propane, butane or pentane.

14. A method according to claim 1 wherein the liquid hydrocarbon substance comprises a multi- component natural gas liquid (NGL).

15. A method according to claim 14 where the drilling is conducted at an offshore oil and gas production facility and wherein the natural gas liquid injected in the mud is collected from a process stream of the production facility.

16. A method according to claim 1 further including the steps of separating the liquid hydrocarbon substance from mud discharged from the well; and the injection step is further defined as injecting separated liquid hydrocarbon substance into the mud flow.

17. A method according to claim 16 wherein the mud discharged from the well is returned to the well following separation.

18. A method according to claim 1 wherein the drilling is conducted at an offshore oil and gas production facility and wherein the liquid hydrocarbon substance is collected from a process stream of the production facility.

* * * * *